US005593323A

United States Patent [19]

Dernehl

[11] Patent Number: 5,593,323

[45] Date of Patent: Jan. 14, 1997

[54] REVERSIBLE POLARITY ACCESSORY CABLE

[75] Inventor: James U. Dernehl, Arlington, Tex.

[73] Assignee: Operating Technical Electronics, Inc., Grand Prairie, Tex.

[21] Appl. No.: 372,348

[22] Filed: Jan. 13, 1995

[51] Int. Cl.[6] ..... H01R 17/18

[52] U.S. Cl. ..... 439/668; 439/638; 439/956

[58] Field of Search ..... 439/218, 220, 439/668, 638, 655, 504, 503, 490

[56] References Cited

U.S. PATENT DOCUMENTS

| | | | |
|---|---|---|---|
| 3,546,657 | 7/1968 | Cook | 439/668 |
| 4,109,193 | 8/1978 | Schultheis | 320/2 |
| 5,201,677 | 4/1993 | Takayama | 439/668 |
| 5,326,283 | 7/1994 | Chen | 439/638 |
| 5,387,136 | 2/1995 | Britton | 439/638 |

*Primary Examiner*—Neil Abrams
*Assistant Examiner*—Eugene G. Byrd
*Attorney, Agent, or Firm*—Jack A. Kanz

[57] ABSTRACT

An adapter for supplying D.C. current from a lighter receptacle to a remote accessory is formed by a plug inserted into the receptacle which has a reversible interconnection with a cable connected to the remote accessory. The end of the cable with the reversible interconnector is marked to visually display the electrical polarity of current supplied to the remote accessory.

20 Claims, 4 Drawing Sheets

REVERSIBLE POLARITY ACCESSORY CABLE

This invention relates to D.C. adapter cables for electrical accessories. More particularly, it relates to adapter apparatus which utilize conventional cigarette lighter receptacles to provide reversible polarity electric current for remote electrical devices.

BACKGROUND OF THE INVENTION

Many remote accessory devices are designed to be powered by mobile direct current (D.C.) sources such as storage batteries and related systems used in automobiles, pleasure boats, etc. These devices are often powered by electric current drawn from a cigarette lighter receptacle. In order to draw current from the lighter receptacle, an adapter must be provided to interface both mechanically and electrically with the lighter receptacle. Such apparatus can exist in a variety of configurations. For example, one end of a conductive cable may be hard-wired into the remote electrical device and the other end adapted to be plugged directly into the lighter receptacle. Alternatively, the remote end of the cable may be provided with a disconnecting plug. Examples of devices which may be thus powered include portable spotlights, car phones, compact disc players, air compressors and thermoelectric coolers.

The power needs of accessory devices vary. Given the wide array of devices in use, it is certain that the power needs of some devices will exceed the capability of many adapters. For example, a lighter adapter designed to power a car phone will not ordinarily carry sufficient current for high powered devices such as thermoelectric devices. Power needs may vary in other respects as well. For example, a thermoelectric device may operate in either a heating mode or a cooling mode, depending on the polarity of the current supplied to the device. Since the polarity of the current available at the lighter receptacle is fixed, and since existing lighter adapters cannot change the polarity, a polarity switch must be incorporated into the accessory employing the thermoelectric device. Such a switch adds to the weight, complexity and cost of the device.

SUMMARY OF THE INVENTION

In accordance with the present invention, a D.C. adapter cable system is provided which not only has increased current carrying capability but includes a reversing connector to reverse polarity without employing an additional switch. The connection between the adapter plug and the cable is coded or marked to immediately display the polarity of the current supplied to the remote accessory. The need for a polarity switch on the remote accessory, with its attendant cost, complexity and weight, is thus eliminated and the user is provided with an immediate visual display of the orientation and polarity of the connection. Other features and advantages of the invention will become more readily understood from the following detailed description taken in connection with the appended claims and attached drawing in which:

Figure 1:
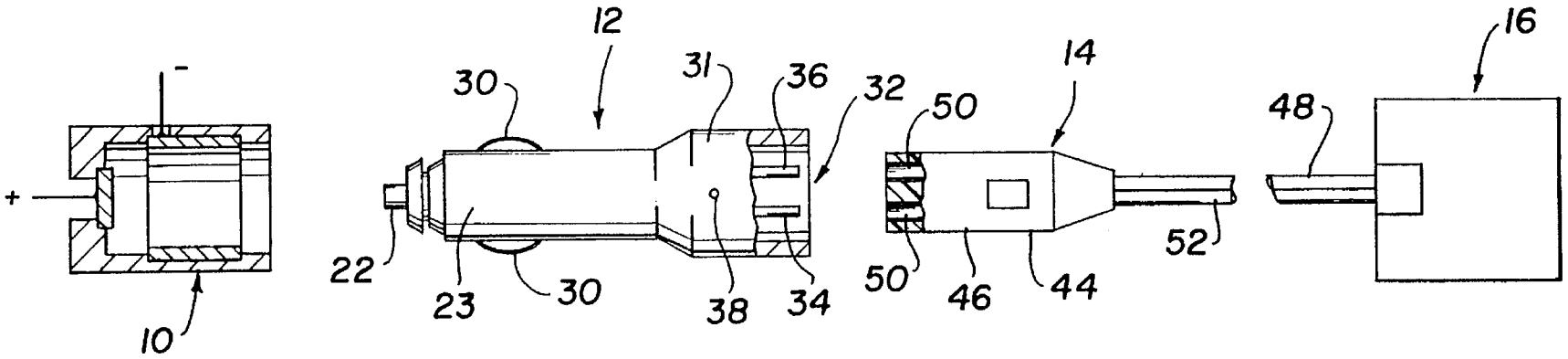
FIG. 1 is a pictorial illustration of a presently preferred embodiment of the invention.
Figure 3A:
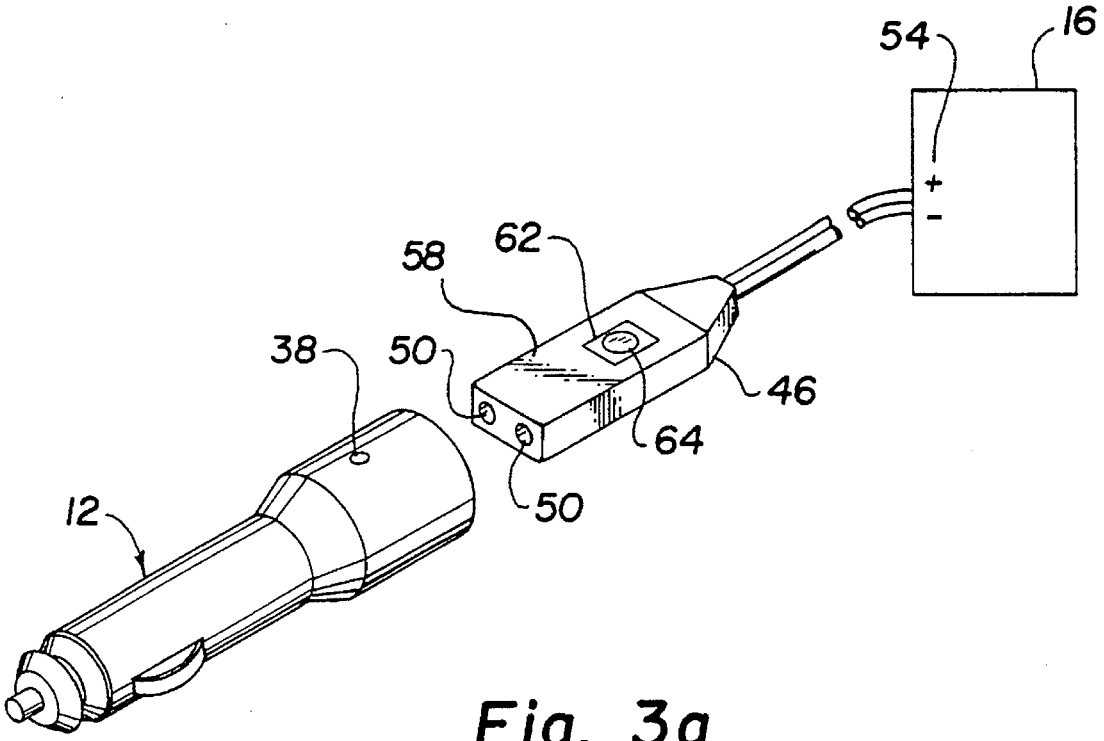
Figure 3B:
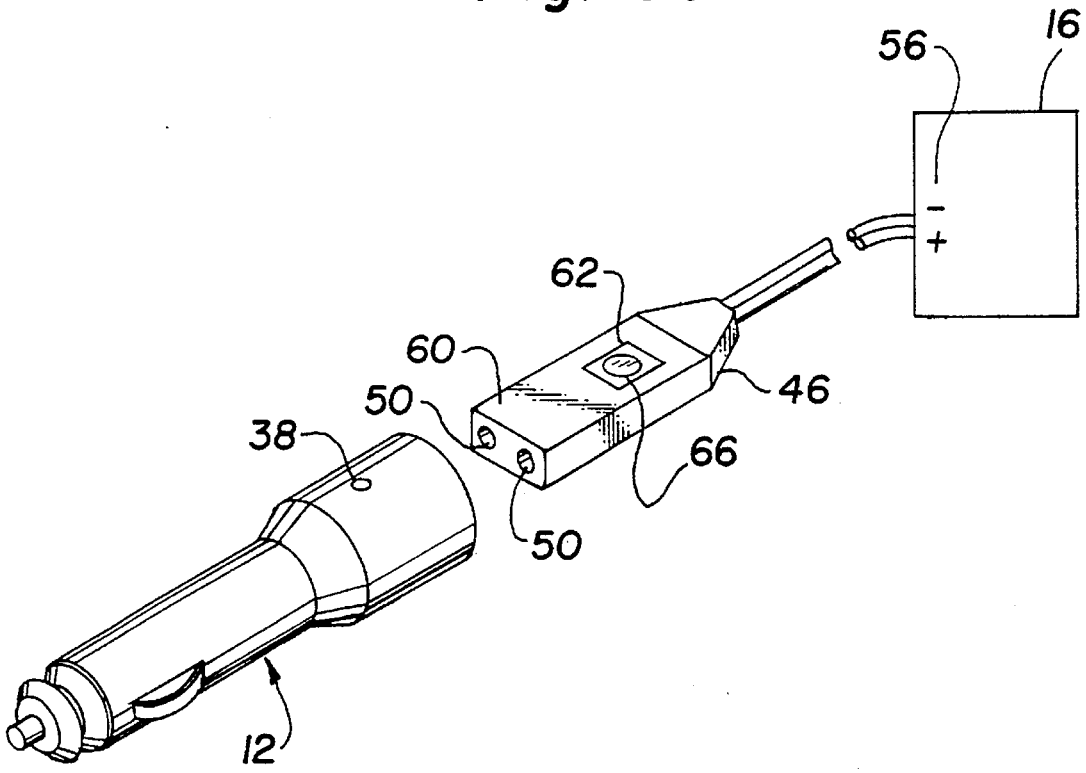
Figure 4:
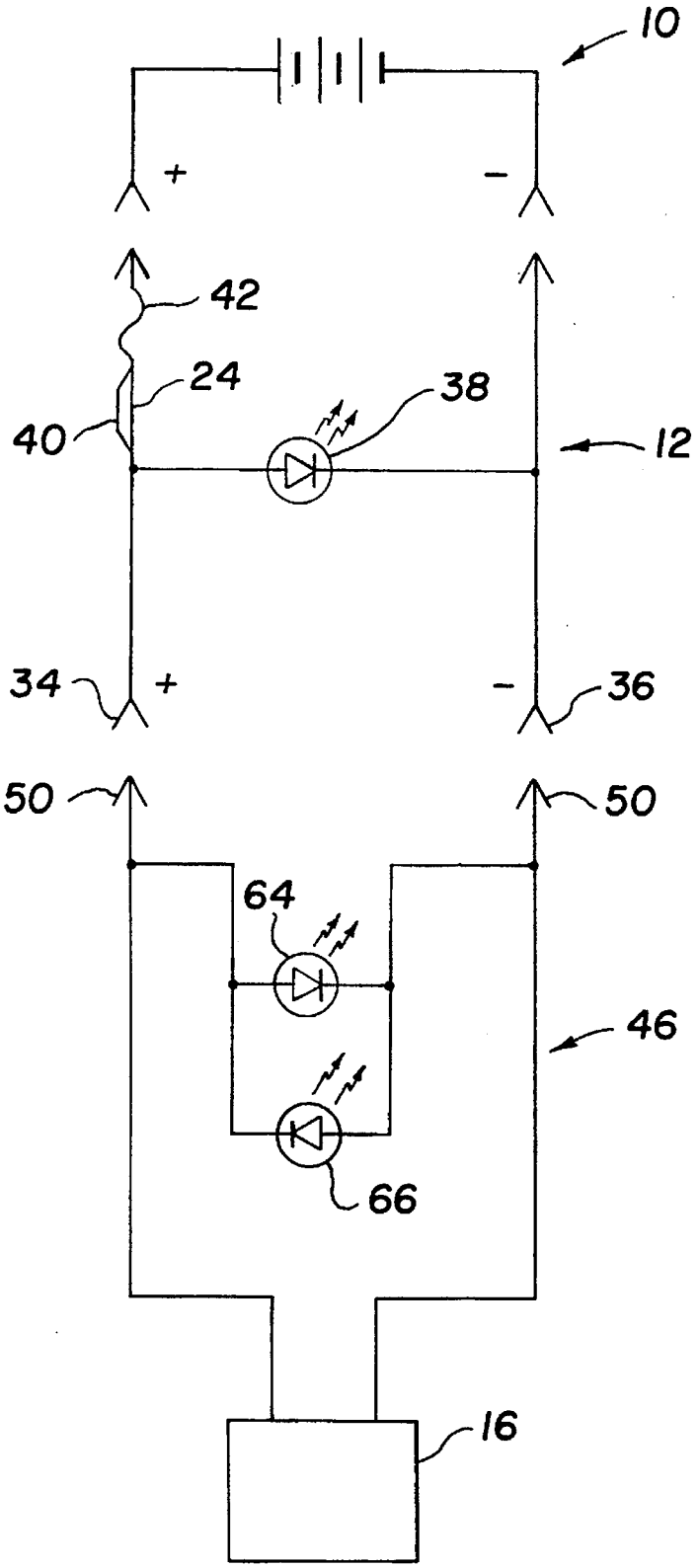

FIG. 3*a* is a pictorial illustration of the adapter system of FIG. 1 showing interconnection to provide a first polarity D.C. current to a remote accessory;

FIG. 3*b* is a pictorial illustration of the adapter system of FIG. 1 showing interconnection to provide a second polarity D.C. current to the remote accessory; and FIG. 4 is an electrical schematic of the presently preferred embodiment of the adapter cable apparatus of the invention.

DESCRIPTION OF THE PREFERRED EMBODIMENT

In the illustration of FIG. 1 a direct current (D.C.) lighter receptacle is designated by the numeral 10 and a D.C. lighter adapter plug is designated by the numeral 12. A D.C. cable 14 is connected between a remote accessory device 16 and plug 12.

Figure 2:
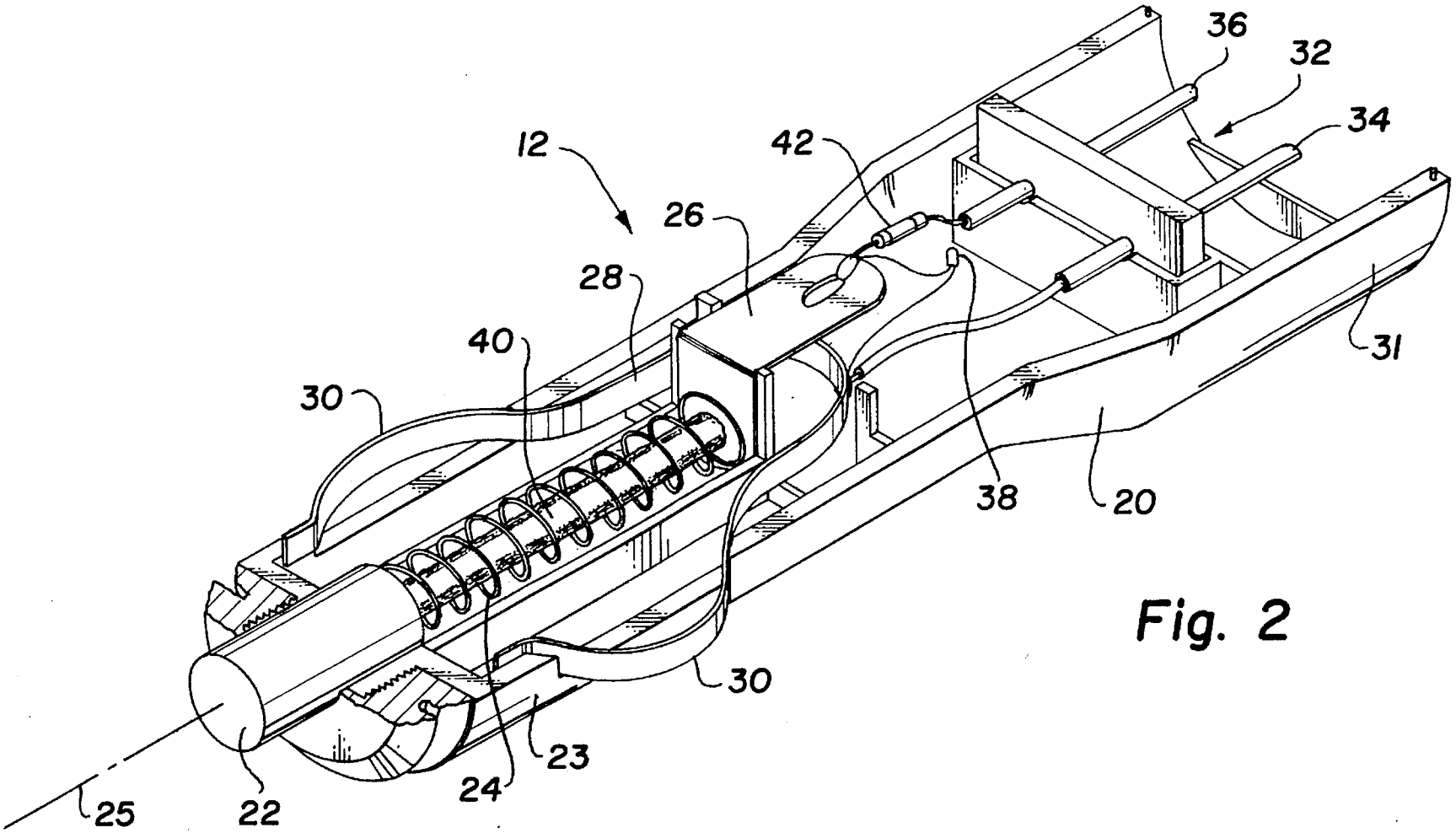
FIG. 2 is a perspective view, partially broken away, of the adapter plug shown in FIG. 1.

The construction of adapter plug 12 is illustrated in FIG. 2 wherein plug housing 20 is broken away to show the arrangement of internal components. A first positive terminal or central probe 22 extends through a first end 23 of housing 12 and is biased into that position by a coil spring conductor 24 extending along a longitudinal axis 25. The opposite end of spring conductor 24 terminates at an L-shaped metal plate 26. A first negative terminal 28 is formed by a single piece of resilient metal bent to form two lobes 30 which protrude outwardly through the sides of the plug housing 20. The lobes 30 form an outer ground shield coaxial with first terminal 22. First negative terminal 28 may also be made with one or more lobes protruding through the side of plug housing 20, if desired. First positive terminal 22 and first negative terminal 28 mate mechanically and electrically with the respective positive and negative terminals in a conventional lighter receptacle 10. It is to be understood that the positive and negative labeling shown in FIG. 1 and negative ground used throughout this disclosure are for illustrative purposes in connection with a negative ground D.C. power source. Obviously, the opposite polarity will be used a with positive ground D.C. source.

At the second or opposite end 31 of plug 12 an output receptacle 32 is defined by a second positive terminal 34 adjacent a second negative terminal 36. A signal lamp 38, preferably a light-emitting diode (LED), is embedded in plug housing 20 to provide visual confirmation that plug 12 is receiving current from lighter receptacle 10. The lamp 38 also provides a visual indication of the orientation of plug 12. In each of the embodiments discussed below, plug 12 is installed into D.C. lighter receptacle 10 with signal lamp 38 facing up.

A second conductor 40 is installed between first positive terminal 22 and L-shaped plate 26. The second conductor 40 is preferably a flexible cable positioned parallel with the current path of spring conductor 24 to increase the current-carrying capability of plug 12 and thus accommodate higher power demands. In the preferred embodiment, second conductor 40 is composed of metallic braid.

A fuse 42 is interposed between the L-shaped plate 26 and the second positive terminal 34. Alternatively the fuse 42 can be interposed between the first negative terminal 28 and second negative terminal 36. This safety feature, which protects costly components within the remote accessory, is typically absent in prior art plugs.

In accordance with the invention, terminals 34 and 36 (at the output of receptacle 32) are geometrically identical to permit reversible interconnection with reversible connector 46 so that the D.C. current supplied to a remote accessory can be switched by axially rotating the reversible connector 46 with respect to plug 12.

As illustrated in FIG. 1, a first end 44 of D.C. cable 14 terminates with a reversible connector 46. The second end 48 terminates in remote accessory 16. Reversible connector 46 has two geometrically identical contacts 50 which reversibly mate electrically and mechanically with terminals 34 and 36 in output receptacle 32. Each contact 50 delivers current to a separate wire. The wires are insulated from each other and integrated into one unit to form a power cable 52. In order to deliver current of reversed polarity, contacts 50 on reversible connector 46 are geometrically identical, thus enabling either contact 50 to mate with either of terminals 34 or 36 in plug output receptacle 32. Since each contact 50 can mate with either terminal, the reversible connector 46 is connectable to plug output receptacle 32 in either of two orientations. A first orientation (shown in FIG. 3*a*) defines a first polarity 54 at remote accessory 16. In the alternative orientation (shown in FIG. 3*b*) reversible connector 46 is axially rotated 180° with respect to plug 12 to present a second polarity 56 at remote accessory 16.

In FIGS. 3*a* and 3*b* opposite sides of reversible connector 46 are designated as a first side 58 and a second side 60. At least one of the opposite sides 58 and 60 is appropriately marked to visually display the orientation of connector 46 (and the resulting polarity of current at remote accessory 16). In the preferred embodiment an indicator 62 is used which comprises a pair of LEDs. First LED 64 (which emits a first color) is embedded in the first side 58 and a second LED 66 (which emits a second color) is embedded in the second side 60. The LEDs are interconnected with the contacts 50 in connector 46 so that when the connector 46 is in the first orientation, the first color LED 64 faces up and is illuminated while the second color LED 66 faces down and is off. When the connector 46 is rotated to the second orientation, the second LED 66 faces up and is illuminated while the first LED 64 faces down and is off. Alternatively, all or a portion of one surface may be a different color from that of the other surface. Other symbols or marks, differing either in form or in color, may be affixed to or formed on or in the opposite sides 58 and 60.

The colors or symbols which represent polarity are preferably chosen to coordinate with the operation of the remote accessory 16. For example, in the embodiment using LEDs the colors can be blue and red to coordinate with the polarity-dependent modes of a thermoelectric heating/cooling device. In this case the LEDs are arranged such that the blue LED is illuminated when the thermoelectric device is operating in the cooling mode and the red LED is illuminated when the thermoelectric device is operating in the heating mode. Since polarity is changed by simply reversing the connector 46, the need for other polarity-reversing switches is eliminated.

An electrical schematic of the preferred embodiment of the invention is shown in FIG. 4. Second conductor 40 is shown adjacent the coiled spring conductor 24 since it is interconnected in parallel therewith. Fuse 42 is shown in the same current path. First LED 64 and second LED 66 are connected in parallel (with reversed polarity) between contacts 50. Similarly, LED 38 is interconnected between contacts 34 and 36 in plug 10.

From the foregoing it will be recognized that the principles of the invention may be employed in various arrangements to obtain the benefit of the many advantages and features disclosed. For example, instead of installing the reversible connector 46 on first end 44 at the interface with output receptacle 32, it might instead be installed on second end 48 at the interface with the remote accessory 16. It is to be understood, therefore, that even though numerous characteristics and advantages of the invention have been set forth together with the details of the structure and function of the invention, this disclosure is to be considered illustrative only. Various changes and modifications in detail, especially in matters of size, shape and arrangement of parts, may be made without departing from the spirit and scope of the invention as defined by the appended claims.

What is claimed:

1. An adapter for supplying D.C. current from a conventional D.C. lighter receptacle to a remote accessory comprising:

(a) a plug having a first positive terminal and a first negative terminal adapted to mate with the respective positive and negative terminals of a conventional D.C. lighter receptacle and having an output receptacle with a second positive terminal and a second negative terminal;

(b) a D.C. cable having first and second ends;

(c) a reversible connector on the first end of said cable having first and second substantially oppositely disposed surfaces and first and second contacts adapted to mate with said second positive terminal and said second negative terminal in said output receptacle in two alternative orientations which change the polarity of electrical connection; and (d) a display on at least one of said first and second surfaces visually indicating the polarity of the interconnection between said reversible connector and said output receptacle.

2. An adapter as defined in claim 1 wherein a fuse is included between said first and second positive terminals or between said first and second negative terminals.

3. An adapter as defined in claim 1 wherein a second conductor is connected in parallel with a first conductor between said first and second positive terminals.

4. An adapter as defined in claim 3 wherein said second conductor comprises a metal braid.

5. An adapter as defined in claim 1 wherein said display comprises a symbol affixed to at least one of said first and second surfaces.

6. An adapter as defined in claim 1 wherein said display comprises a LED embedded in at least one of said first and second surfaces.

7. An adapter as defined in claim 1, wherein said display comprises a first color identifying said first surface and a second color identifying said second surface.

8. An adapter as defined in claim 7 wherein said display comprises a first color LED identifying said first surface and a second color LED identifying said second surface.

9. The combination comprising an adapter as defined in claim 1 and a remote electrical device connected to the second end of said cable adapted to operate in alternative polarity-dependent modes.

10. The combination defined in claim 9 wherein said device is thermoelectric and operable in alternative heating and cooling modes and wherein said display is blue when said device is operating in the cooling mode and red when said device is operating in the heating mode.

11. The combination defined in claim 10 wherein said display comprises a blue LED and a red LED connected in parallel in opposite polarities between said first and second contacts.

12. An adapter for supplying D.C. current from a conventional D.C. lighter receptacle to a remote accessory comprising:

(a) a plug with a first end having a central probe and an outer ground coaxially aligned therewith adapted to mate electrically and mechanically with a D.C. lighter receptacle and a second end having substantially geometrically identical positive and negative output terminals;

(b) a D.C. cable having a reversible connector with a pair of contacts adapted to mate with said output terminals in a first position or a second position when said connector is axially rotated 180° from the first position; and (c) a display on said connector visually indicating the orientation of said connector.

13. An adapter as defined in claim 12 wherein a fuse is included between said probe and said positive output terminal or between said ground shield and said negative output terminal.

14. An adapter as defined in claim 12 including first and second conductors connected in parallel between said probe and said positive output terminal.

15. An adapter system as defined in claim 12 wherein said display comprises symbols affixed to said connector.

16. An adapter system as defined in claim 12 wherein said display comprises first and second colors.

17. An adapter system as defined in claim 16 wherein said display comprises a first color LED and a second color LED.

18. In combination, an adapter system as defined in claim 12 connected to a remote device operable in at least two polarity- dependent modes.

19. A combination as defined in claim 12 wherein said display indicates the polarity-dependent mode in operation at said device.

20. An adapter for supplying D.C. current from a conventional D.C. lighter receptacle to a remote accessory comprising:

(a) a plug with a first end having a central probe and an outer ground coaxially aligned therewith adapted to mate electrically and mechanically with a D.C. lighter receptacle;

(b) a D.C. cable extending from said plug and having a reversible connector on the end thereof remote from said plug which has a pair of contacts adapted to selectively mate with a remote accessory in either a first position or a second position adapted to change the polarity of electrical connection; and (c) a display on said reversible connector visually indicating the polarity of said electrical connection.

* * * * *